United States Patent [19]

Aoyama

[11] 4,124,004

[45] Nov. 7, 1978

[54] EXHAUST GAS RECIRCULATION CONTROL SYSTEM

[75] Inventor: Syunichi Aoyama, Yokohama, Japan

[73] Assignee: Nissan Motor Company, Ltd., Japan

[21] Appl. No.: 795,970

[22] Filed: May 11, 1977

[30] Foreign Application Priority Data

May 14, 1976 [JP] Japan ..... 51/55118

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,974,807 | 8/1976 | Nohira et al. | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,047,510 | 9/1977 | Nakajima et al. | 123/119 A |
| 4,069,798 | 6/1978 | Thornburgh | 123/119 A |
| 4,071,003 | 1/1978 | Aono | 123/119 A |
| 4,071,006 | 1/1978 | Harada | 123/119 A |

*Primary Examiner*—Wendell E. Burns

*Attorney, Agent, or Firm*—Robert E. Burns; Emmanuel J. Lobato; Bruce L. Adams

[57] ABSTRACT

An EGR control valve is closably disposed in an EGR passageway connecting an intake passageway and an exhaust gas passageway which leads to an internal combustion engine. The EGR control valve is operated to control recirculated exhaust gas flow by varying the exhaust gas pressure in a chamber between a restriction disposed in the EGR passageway and the EGR valve, in accordance with variations in a venturi vacuum in the intake passageway to prevent the recirculated exhaust gas flow from being affected by the exhaust gas pressure in the EGR passageway upstream of the chamber. Furthermore, the EGR control valve is arranged to be controlled so that the amount of the recirculated exhaust gas is reduced during high engine speed operation of the engine.

11 Claims, 3 Drawing Figures

EXHAUST GAS RECIRCULATION CONTROL SYSTEM

BACKGROUND OF THE INVENTION

The present invention relates generally to an exhaust gas recirculation (EGR) control system of a type which comprises an EGR passageway having a restriction formed upstream of the EGR control valve to define a chamber between the restriction and the EGR control valve and particularly to an EGR control system of this type in which the EGR control valve is operated to reduce and increase the exhaust gas pressure in the chamber between the restriction and the EGR control valve in accordance with increases and decreases in the venturi vacuum, respectively.

SUMMARY OF THE INVENTION

It is the principle object of the present invention to provide an improved EGR control system for an internal combustion engine, by which the emission level of nitrogen oxides is greatly lowered, improving engine driveability and improving fuel consumption and engine power output during high engine speed operating condition.

Another object of the invention to provide an EGR control system improved to comprise means for varying the pressure in the chamber interposed between the restriction and the EGR control valve in accordance with variations in a venturi vacuum in the engine intake passageway to prevent the recirculated exhaust gas flow from being greatly affected by variations in the exhaust gas pressure in the EGR passageway upstream of the chamber and to render the recirculated exhaust gas flow dependent on the pressure differential between the EGR passageway upstream of the orifice and chamber between the orifice and the EGR control valve so that the recirculated exhaust gas flow is accurately controlled.

A further object of the invention to provide an EGR control system improved to comprise means for reducing the amount of recirculated exhaust gas to prevent the power output and the fuel consumption of the engine from being degraded during high engine speed operating condition.

These objects are attained by operating the EGR control valve in accordance with the difference between the pressure in the EGR passageway between the restriction and the EGR control valve and the venturi vacuum, or by providing a control valve for controlling in accordance with the difference between, the atmospheric pressure, the pressure in the EGR passageway between the restriction and the EGR control valve, and the venturi vacuum, the flow of atmospheric air admitted for diluting the suction vacuum for operating the EGR control valve and additionally by providing a check valve for admitting in response to a suction vacuum increased above a predetermined value the suction vacuum into the atmospheric pressure for operating the control valve.

BRIEF DESCRIPTION OF THE DRAWINGS

Other objects, features and advantages of the present invention will become more apparent from the following detailed description taken in connection with the accompanying drawings in which.

DESCRIPTION OF THE PREFERRED EMBODIMENTS

It has been proposed that an exhaust gas recirculation (EGR) control system serves to reduce the production of nitrogen oxides (NOx) in combustion of an internal combustion engine by controlling the maximum combustion temperature below a certain level by recirculating or feeding into air drawn by the engine exhaust gas emitted from the engine. Accordingly, it is necessary to control the flow of recirculated engine exhaust gas with enough consideration for the operating performance or driveability and the fuel consumption of the engine.

Figure 1:
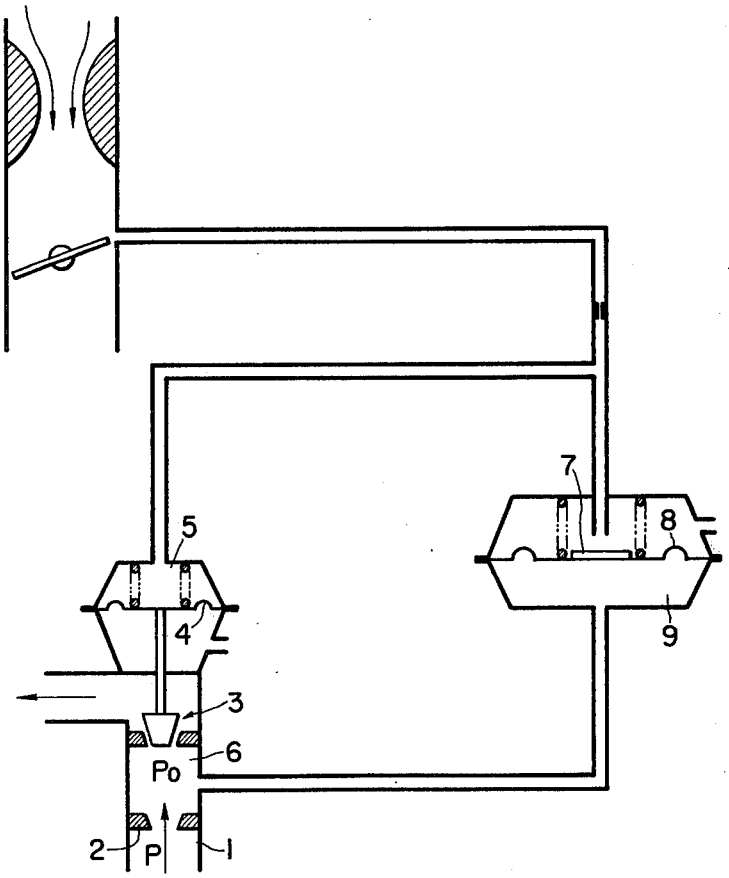
FIG. 1 PRIOR ART
FIG. 1 is a schematic view of the conventional EGR control system as per the introduction of the present invention.

It is usually desirable to maintain at a predetermined or constant value the EGR rate, that is, the rate of the recirculated exhaust gas flow to the flow of air taken into the engine. As an expedient for attaining this purpose, there is proposed an EGR control system of a back pressure proportioning type as shown in FIG. 1 of the accompanying drawings. This conventional EGR control system comprises an EGR passageway 1 formed therein with a restriction or orifice 2 for controlling the recirculated exhaust gas flow, an EGR control valve 3 disposed in the EGR passageway 1 downsteam of the restriction 2, and a diaphragm unit including a flexible diaphragm 4 which is operatively connected to the EGR control valve 3 and has on a side thereof a fluid chamber 5 fed with a suction vacuum. The EGR passageway 1 has a chamber 6 defined between the restriction 2 and the EGR control valve 3. A pressure converting valve 7 is provided for controlling the flow of atmospheric air admitted for diluting the suction vacuum fed into the fluid chamber 5 and includes a flexible diaphragm 8 operatively connected to the valve 7 and having on a side thereof a fluid chamber 9 communicating with the chamber 6 of the EGR passageway 1. The valve 7 is operated in accordance with a positive pressure $P_o$ in the chamber 6 and controls the suction vacuum in the fluid chamber 5 to a value related to the pressure $P_o$. The degree of opening of the EGR control valve 3 is feedback controlled by the suction vacuum in the fluid chamber 5 to maintain the pressure $P_o$ in the chamber 6 constant during most of engine operations. As a result, the recirculated exhaust gas flow is represented as a function of the pressure P of engine exhaust gas in the EGR passageway 1 upstream of the restriction 2 which pressure P is about proportional to the square of the engine taken air flow. Accordingly, the recirculated exhaust gas flow is controlled to an about constant ratio to the engine intake air flow.

When the recirculated exhaust gas flow is a function of the pressure P of exhaust gas in the EGR passageway 1 upstream of the orifice 2 in this manner, the recirculated exhaust gas flow is very easily affected by variations in the exhaust gas pressure P. Accordingly, when the exhaust gas pressure P is not proportional to the square of the engine taken air flow, the reliability on the control of the recirculated exhaust gas flow which is effected by the conventional EGR control system is considerably reduced.

The exhaust gas pressure is often varied independently of the engine taken air flow by parameters such as the injection of secondary air into the exhaust gas system, the temperature of the engine exhaust gas, the flow resistance of the exhaust gas passageway and so on. Accordingly, the exhaust gas pressure is highly unreliable as compared with a carburetor venturi vacuum as a function of the engine taken air flow.

Furthermore, since the exhaust gas pressure P does not have such a large absolute value and is varied over a fairly wide range, the conventional EGR control system has been unable to control the EGR rate to a constant or predetermined value. As a result, the conventional EGR control system has been apt to unsatisfactorily reduce the production of nitrogen oxides and to render the driveability of the engine unstable.

On the other hand, a conventional EGR control system has recirculated engine exhaust gas at a similar predetermined EGR rate throughout all engine operating conditions. As a result, under high speed and low load engine operating condition in which the production of nitrogen oxides (NOx) is relatively small, the recirculated exhaust gas flow has become excessive to degrade the power output and the fuel consumption or fuel economy of the engine.

Therefore, the present invention contemplates to overcome the difficulties encountered in the conventional EGR control system in order to improve the engine driveability and improve the fuel consumption and the engine power output during high engine speed operating condition, particularly during high engine speed and low engine load operating condition.

Figure 2:
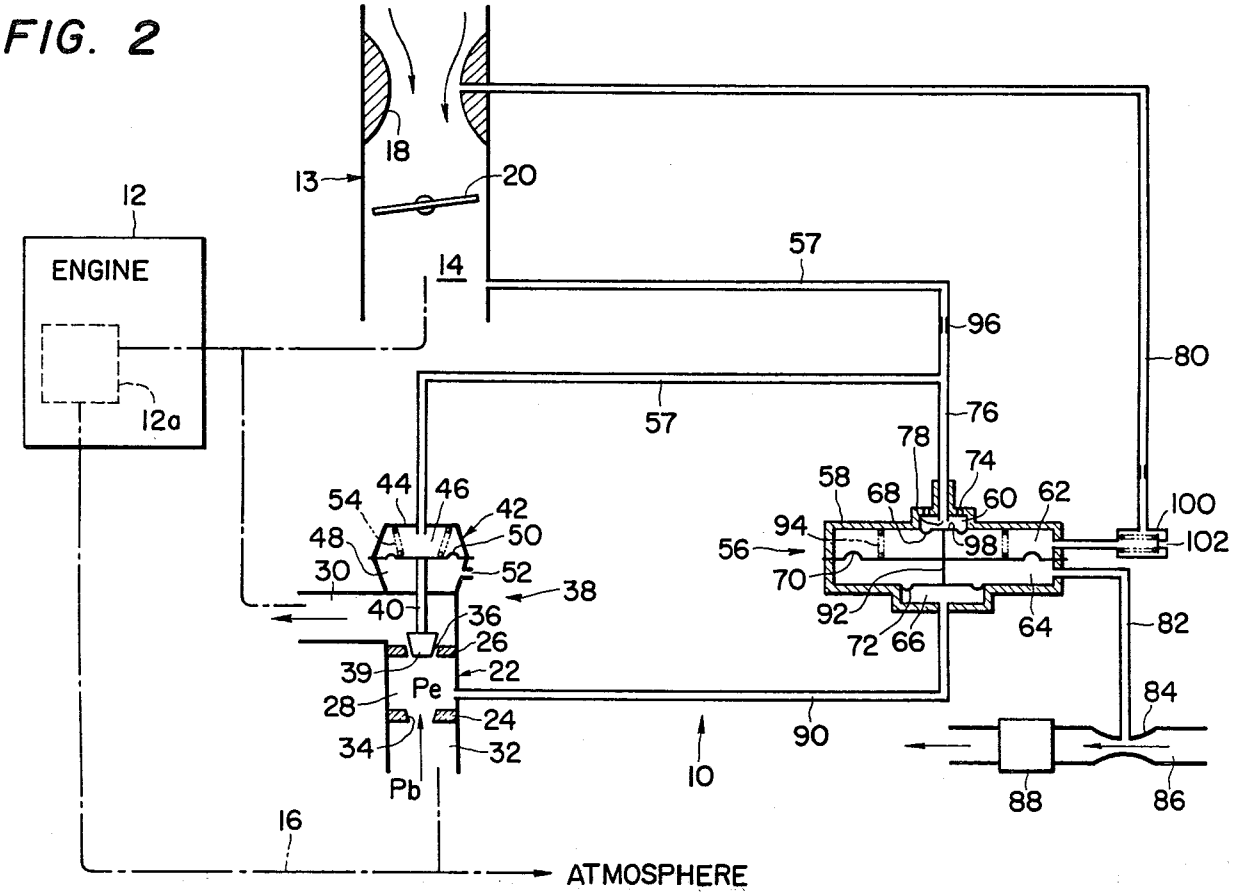
FIG. 2 is a schematic view of a preferred embodiment of an EGR control system according to the invention.

Referring now to FIG. 2 of the drawings, a preferred embodiment of an exhaust gas recirculation (EGR) control system 10 according to the invention is shown as combined with an internal combustion engine 12 which includes a carburetor 13, and intake passageway 14 passing through the carburetor 13 and providing communication between the atmosphere and the combustion chamber or chambers 12*a* of the engine 12 for conducting air thereinto, and an exhaust gas passageway 16 providing communication between the engine 12 and the atmosphere for conducting thereto exhaust gas emitted from the engine 12. The intake passageway 14 has a venturi 18 formed therein and a throttle valve 20 rotatably mounted downstream of the venturi 18. The EGR control system 10 comprises an EGR passageway 22 providing communication between the exhaust gas passageway 16 and the intake passageway 14 downstream of the throttle valve 20 for recirculating or conducting engine exhaust gas into the intake passageway 14. The EGR passageway 22 if formed therein with partition members 24 and 26 which divide the EGR passageway 22 into a chamber 28 defined between the partition members 24 and 26 and upstream and downstream parts 30 and 32 located, respectively, upstream and downstream of the chamber 28. The partition member 24 is formed therethrough with an orifice 34 which provides communication between the upstream part 30 and the chamber 28 and forms together with the partition member 24 a restriction of the EGR passageway 22 which controls the flow of recirculated engine exhaust gas. The partition member 26 or a valve seat is formed therethrough with an aperture or passage 36 which provides a communcation between the chamber 28 and the downstream part 32.

An EGR control valve asembly 38 is disposed such that its valve head 39 in the EGR passageway 22 is movable relative to the partition member 26. The valve head 39 is secured to a valve stem 40 extending therefrom externally of the EGR passageway 22. The EGR control valve assembly 38 includes a diaphragm unit 42 for operating the EGR control valve 38. The diaphragm unit 42 is composed of a housing 44 having first and second fluid chambers 46 and 48, and a flexible diaphragm 50 separating the fluid chambers 46 and 48 from each other. The fluid chamber 48 is communicated through a hole 52 with the atmospher. A spring 54 is provided to normally urge the diaphragm 50 in a direction to cause the valve head 39 to close the aperture 36. In this embodiment, the fluid chamber 46 of the diaphragm unit 42 communicates with the intake passageway 14 downstream of the throttle valve 20 through a passage 57 to receive a suction vacuum in the passageway 14. Alternatively, the fluid chamber 46 may communicate with the intake passageway 14 at a location which is just on the atmospheric or upstream side of the peripheral edge of the throttle valve 20 in its fully closed position and is varied to the suction vacuum or downstream side of the throttle valve 20 opened above a certain amount. The fluid chamber 48 of the diaphragm unit 42 communicates with the atmosphere through an opening 54.

A pressure regulating valve assembly 56 is provided to control the vacuum for operating the EGR control valve 38. The valve assembly 56 comprises a housing 58 having therein four chambers 60, 62, 64 and 66, and three flexible diaphragms 68, 70 and 72. The diaphragm 68 separates the chamber 60 and 62 from each other. The diaphragm 70 separates the chambers 62 and 64 from each other. The diaphragm 72 separates the chambers 64 and 66 from each other. The chamber 60 communicates with the atmosphere through an opening 74 and with the passage 57 through a passage 76 and an inlet port 78. The chamber 62 communicates with the venturi 18 through a passage 80. The chamber 64 is communicated through a passage 82 with a venturi portion 84 formed at the inner surface of an air induction passage 86 leading to an air pump 88. The air pump 88 may be arranged to supply so-called secondary air into the exhaust system of the engine to oxidize hydrocarbons and carbon monoxide therein. The air pump 88 is driven by the engine and accordingly its air discharge (or charge) amount is proportional to the engine speed of the engine 12. The chamber 66 communicates with the chamber 28 of the EGR passageway 22 through a passage 90. The disphragm 70 has a working or pressure acting surface area larger than that of each of the diaphragms 68 and 72. The diaphragms 68, 70 and 72 are fixedly connected to each other, for example, by means of a rod 92 so that they are operated as one body. A spring 94 is provided to integrally urge the diaphragms 68, 70 and 72 in a direction opposed by the atmospheric pressure in the chamber 70. An orifice 96 is formed in the passage 57 on the intake passageway side of the junction to which passage 76 is connected. A control valve 98 is located in the chamber 60 movably relative to the port 78 to control the flow of atmospheric air into the port 78 and is fixedly secured to the diaphragm 68.

A relief valve 100 is disposed in the passage 80 and the passage 80 has a port 102 providing communication between the passage 80 and the atmosphere. The relief valve 100 closes and opens the port 102 to obstruct and provide communication between the passage 80 and the atmosphere when the venturi vacuum is below and above a predetermined value, respectively. As shown, an orifice 104 is disposed in the passage 80 upstream of the relief valve 100.

The operation of the thus arranged EGR control system 60 will be discussed hereinafter.

When the venturi vacuum is increased, the diahragms 68, 70 and 72 are integrally moved so that the valve 98 reduces the degree of opening of the port 78 to reduce the flow of atmospheric air admitted into the passage 76 and therefore the degree of dilution of the suction vacuum conducted into the chamber 46 is reduced. As a result, the degree of opening of the EGR control valve 38 is increased to reduce the pressure $P_e$ in the chamber 28 and therefore in the chamber 66 of the valve assembly 56. The decrease in the pressure $P_e$ moves the diaphragms 68, 70 and 72 integrally to increase the degree of opening of the control valve 98 to the port 78 to increase the flow of atmospheric air admitted into the passage 76. As a result, the dilution of the suction vacuum by the atmospheric air is increased to reduce the degree of opening of the EGR control valve 38 to increase the pressure $P_e$ in the chamber 28. By the repetition of such an operation or such a feedback control, the pressure $P_e$ and the degree of opening of the EGR control valve 38 are converged respectively to values in which the pressure $P_e$ is balanced with the venturi vacuum to increase and reduce the recirculated exhaust gas flow in accordance with the increases and decreases in the venturi vacuum.

When the pressure $P_e$ in the chamber 28 is varied regardless of the venturi vacuum by variations in the suction vacuum, the EGR control valve 38 is operated to cancel the variations in the pressure $P_e$ by the pressure regulating valve assembly 56. In this instance, when the pressure $P_e$ is a negative pressure and the negative pressure is increased, the diaphragms 68, 70 and 74 are integrally moved to increase the degree of opening of the control valve 98 to the port 78. As a result, the degree of opening of the EGR control valve 38 is reduced similarly as mentioned above to reduce the influence of the suction vacuum on the pressure $P_e$ to restore same to an initial value to prevent the recirculated exhaust gas flow from being varied irrespective of the venturi vacuum.

With increased engine speeds, the vacuum in the venturi portion 84 is increased and then the increased vacuum is supplied through the passage 82 into the chamber 64. As a result, the diaphragm 70 is pulled downwardly in the drawing to decrease the effect of the venturi vacuum supplied to the chamber 62. Therefore, during high engine speed operation, the opening degree of the valve 98 to the port 78 cannot be decreased with the increased venturi vacuum generated at the venturi 18 of the carburetor 13. This suppresses the increase of the intake passage vacuum supplied to the chamber 46 of the EGR control valve assembly 38 and consequently the increase of the difference between the pressures $P_b$ and $P_e$ is suppressed since the EGR control valve assembly 38 is operated in accordance with the intake passage vacuum supplied to the chamber 46.

As apparent from the foregoing, the amount of the exhaust gases recirculated into the engine 12 is not increased regardless of increased venturi vacuum generated at the venturi portion 18 of the intake passage 14 and therefore the EGR rate is gradually lowered with the increased engine speeds.

It will be understood that, during medium engine speed and engine load operations which are most frequently encountered in the engine 12, a relatively large amount of the exhaust gas is recirculated into the engine 12 and accordingly the generation of nitrogen oxides (NOx) in the engine is effectively suppressed. Furthremore, the EGR rate is decreased with the increased engine speed. This results in an improved fuel consumption (the fuel amount consumed for producing a unit power) and an improved engine power output during high engine speed operations, causing appropriate exhaust gas control and engine driveability.

It is to be noted that, since the vacuum generated at the venturi portion 84 in the passage 86 leading to the engine driven air pump is used as an engine speed signal in the embodiment shown in FIG. 2, the EGR control is accurately carried out because the vacuum at the venturi portion 84 is high in responsibility as a function of the engine speed.

When the relief valve 100 is provided and the venturi vacuum generated at the venturi 18 reaches the predetermined value during the high engine speed operations, the relief valve 100 is open to admit atmospheric air into the chamber 62 to prevent the opening degree of the control valve 98 to the port 78 from being reduced above a predetermined amount even if the venturi vacuum is increased above the predetermined value. Accordingly, the pressure $P_e$ in the chamber 28 is prevented from being reduced below a predetermined level to prevent the recirculated exhaust gas flow from being increased above a predetermined value.

It is appreciated from the foregoing description that the EGR rate gradually decreases as the amount of air inducted through the carburetor 13 increases. Furthermore, it will be noted that by cooperation of the relief valve 100 and the vacuum applied to the chamber 64, the EGR rate is sufficiently lowered at high engine speed and low engine load operating range in which the emission level of NOx is, in general, lower, causing the stable engine operation and improved fuel consumption at this engine operating range.

At low engine speed and high load operating range whose venturi vacuum in the passage 14 is similar to that at the high engine speed and low engine load operating range, the EGR rate is higher than that at the high engine speed and low engine load operation, since the pressure in the chamber 64 is not affected by the vacuum generated at the venturi portion 84 of the passage 86 leading to the air pump 88. Therefore, this suppresses NOx generation which increases at high engine load operating range.

In this case, it is preferable to set the varying amount of the pressure $P_e$ in the chamber 28 at a large value as compared with the corresponding amount of the pressure $P_b$ in the upstream part 32 in order to reduce the influence exerted on the pressure $P_e$ by the pressure $P_b$ which is increased with increases in the engine taken air flow during the engine high speed and high load operation.

Figure 3:
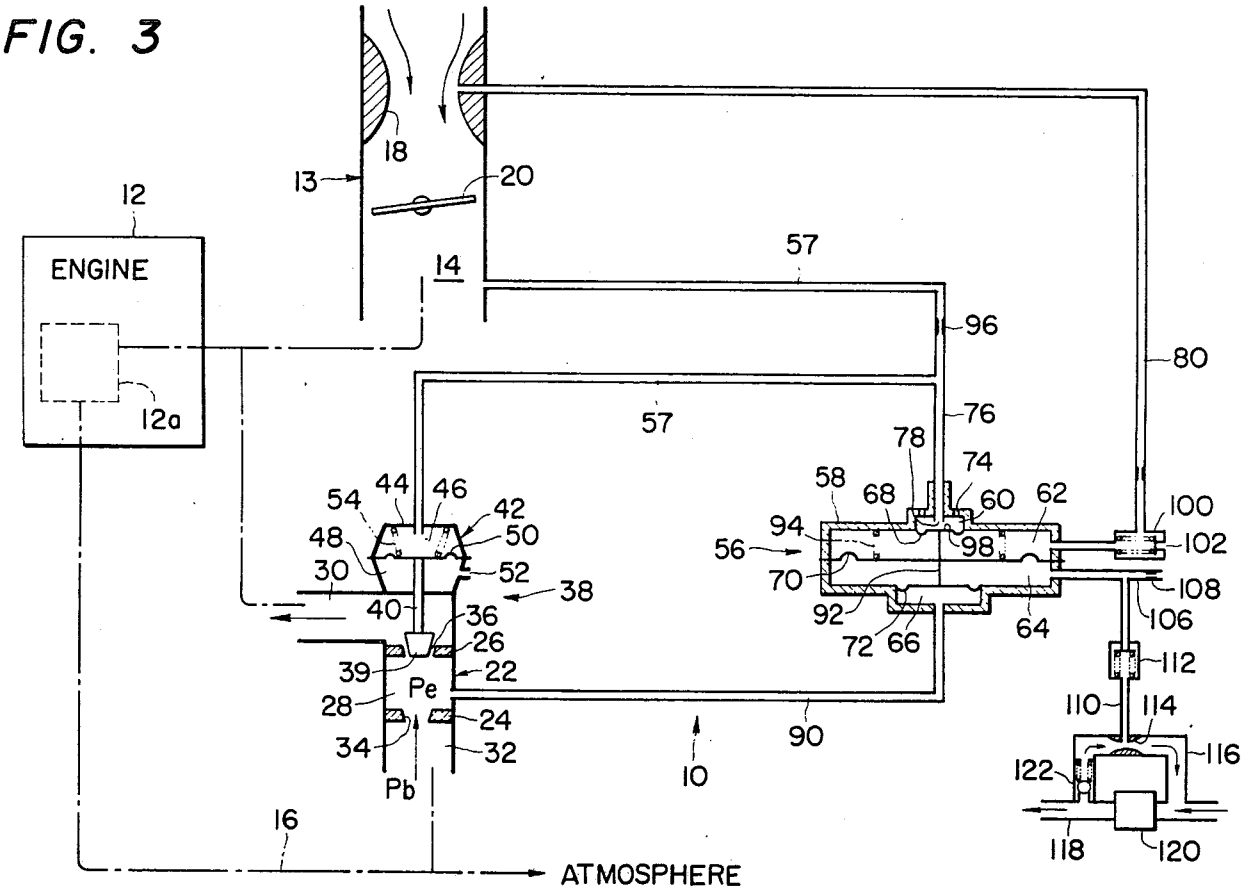
FIG. 3 is a schematic view of another preferred embodiment of an EGR control system according to the invention.

FIG. 3 illustrates another preferred embodiment of the EGR control system according to the present invention in which like components and parts are designated by the same reference numerals as those in FIG. 2. This embodiment is similar to that shown in FIG. 2 with the exception that the vacuum generated by the action of the oil pump is used as the engine speed signal supplied to the chamber 64 of the pressure regulating valve assembly 56.

As shown, an air passage 106 is connected to the chamber 64 of the pressure regulator valve assembly 56. The air passage 106 is communicated through an orifice 108 with the atmosphere. A vacuum passage 110 is connected to the air passage 106 downstream of the orifice 108 and is equipped with a check valve 112 in its middle portion. The vacuum passage 110 is connected to a venturi portion 114 formed in a relief passage 116 connecting to an oil discharge passage 118 connecting to a discharge side of an oil pump 120 for supplying under pressure a lubricating oil to various required portions of the engine 12. A relief valve 122 is disposed in the relief passage 112 upstream side of the venturi portion 114. The relief valve 112 is arranged to open to allow the pressurized oil from the oil discharge passage 118 to flow through the relief passage 116 when the oil pressure in the oil discharge passage 118 exceeds a predetermined level. It will be understood that the amount of the oil flowing through the relief passage 116 increases as the oil amount discharged from the oil pump 120 increases. Therefore, the vacuum generated at the venturi portion 114 is proportional only to the engine speed and accordingly is a function of engine speed.

With the thus arranged EGR control system 10, when the engine speed exceeds a predetermined level, the discharge amount of the oil pump 120 is increased so that the oil pressure in the passage 118 exceeds the predetermined level. Then, the relief valve 112 opens to cause the oil from the passage 118 to flow through the relief passage 116. Accordingly, the vacuum at the venturi portion 114 in the relief passage 116 increases with the increased engine speed. The vacuum generated at the venturi portion 114 is applied through the check valve 112 to the chamber 64 of the pressure regulating valve assembly 56 to compensate the force exerted on the diaphragm 70 which force results from the venturi vacuum in the intake passage 14.

It will be understood that, in the embodiment of FIG. 3, the engine speed signal from the relief passage 116 begins to be applied to the chamber 64 to initiate the above-mentioned compensation when the engine speed reaches the predetermined level. In this connection, in the embodiment of FIG. 2, the engine speed signal from the passage 86 leading to the air pump 88 gradually acts on the chamber 64 of the pressure regulating valve assembly 56 since the low engine speed operate.

While only the vacuums due to the air pump 88 and the oil pump 120 have been shown and described to be used as the engine speed signals for compensating the vacuum force applied to the chamber 62 of the pressure regulating valve assembly 56, a vacuum due to a fuel pump (not shown) may be used as the engine speed signal.

It will be appreciated that the present invention provided an EGR control system in which the EGR control valve is operated to control recirculated exhaust gas flow by varying the exhaust gas pressure in the chamber between the restriction and the EGR control valve in accordance with variations in a venturi vacuum in an engine intake passageway to prevent the recirculated exhaust gas flow from being affected by the exhaust gas pressure in the EGR passageway upstream of the chamber and as a result which accurately controls the recirculated exhaust gas flow in accordance with the engine taken air flow to satisfactorily reduce the production of nitrogen oxides (NOx) and to increase the stability of operation of the engine.

Moreover, with the EGR control system according to the present invention, the fuel consumption and power output of the engine are improved during the high engine speed operating condition in which a high EGR rate is, in general, not desirable for obtaining required high engine power output and excellent fuel consumption or fuel economy and for preventing the component parts of the EGR control system from being thermally damaged by the action of high temperature exhaust gas. Particularly during high engine speed and low load engine operating condition, the high EGR rate is not necessary since the NOx generation in the engine is, in general, less during that operating condition.

What is claimed is:

1. An exhaust gas recirculation (EGR) control system in combination with an internal combustion engine including means defining an intake passage providing communication between the atomsphere and the combustion chamber of the engine and having a venturi formed therein, and means defining an exhaust gas passageway providing communication between the engine and the atomsphere, said EGR control system comprising:

means defining an EGR passageway providing communication between the exhaust gas passageway and the intake passageway for recirculating thereinto exhaust gas emitted from the engine, said EGR passageway having therein a restriction for restricting said EGR passageway;

an EGR control valve disposed in said EGR passageway downstream of said restriction to define a first chamber interposed between said restriction and said EGR control valve and operable in opposite directions to increase and reduce the pressure of engine exhaust gas in said first chamber for controlling the flow of recirculated engine exhaust gas;

operating means for operating said EGR control valve in opposite directions to increase and reduce the exhaust gas pressure in said first chamber in accordance with a decrease and an increase in said exhaust gas pressure and in accordance with a decrease and an increase in a venturi vacuum in said venturi, respectively; and means for decreasing the effect of said venturi vacuum applied to said operating means during high engine speed engine operation of the engine.

2. An EGR control system as claimed in claim 1, in which said operating means comprises:

a first flexible diaphragm defining said second chamber which communicates with said intake passageway to have developed therein a vacuum by a vacuum source, said flexible diaphragm operatively connected to said EGR control valve so that said control valve is operated in opposite directions to increase and reduce said exhaust gas pressure in response to a decrease and an increase in said vacuum in said second chamber, respectively;

passage-defining means communicating with said second chamber and having an inlet port communicating with the atmosphere for admitting into said passage-defining means atmospheric air for diluting said vacuum in said second chamber;

a pressure regulating valve located movably relative to said inlet port of said passage-defining means for controlling the flow of atmospheric air admitted into said inlet port; and second operating means operatively connected to said pressure regulating valve reduces and increases the flow of atmospheric air into said inlet port in response to an increase and a decrease in said venturi vacuum and in response to an increase and a decrease in said exhaust gas pressure for reducing and increasing the dilution of said vacuum in said second chamber by atmospheric air for causing said diaphragm to operate said EGR control valve in opposite directions to reduce and increase said exhaust gas pressure, respectively.

3. An EGR control system as claimed in claim 2, in which said second operating means comprises:

a second flexible diaphragm defining a third chamber communicating with said venturi to receive said venturi vacuum therefrom and a fourth chamber; and a third flexible diaphragm defining said fourth chamber and a fifth chamber communicating with said first chamber to receive said exhaust gas pressure therefrom, said third flexible diaphragm being fixedly connected to said second diaphragm, said second and third diaphragms being operatively connected to said pressure regulating valve so that said pressure regulating valve is operated to reduce and increase the flow of atmospheric air into said inlet port in response to an increase and a decrease in said venturi vacuum in said third chamber and in response to an increase and a decrease in said exhaust gas pressure in said fifth chamber, respectively.

4. An EGR control system as claimed in claim 3, in which said means for decreasing the venturi vacuum effect, comprises means for supplying a vacuum into said fourth chamber of said second operating means during high engine speed operation of the engine.

5. An EGR control system as claimed in claim 4, in which the vacuum supply means includes:

an air pump driven by the engine;

means defining an air induction passage connected to said air pump to induct air therethrough into said air pump;

a venturi portion formed in said air induction passage; and means defining a vacuum passage providing communication between said venturi portion and said fourth chamber.

6. An EGR control system as claimed in claim 5, in which said means for decreasing the venturi vacuum effect, further comprises means for decreasing said venturi vacuum applied to said third chamber of said second operating means during the high engine speed engine operation.

7. An EGR control system as claimed in claim 6, including second passage-defining means providing communication between said venturi and said third chamber, in which the venturi vacuum decreasing means includes a relief valve disposed in said second passage-defining means, said relief valve being arranged to open to induct air into said second passage-defining means during high engine speed and high engine load operations of the engine.

8. An EGR control system as claimed in claim 4, in which the vacuum supply means includes:

an oil pump driven by the engine;

means defining an oil discharge passage connected to said oil pump to flow therethrough the oil pressurized by said oil pump;

means defining a relief passage connected to said oil discharge passage;

a relief valve disposed in said relief passage when the oil pressure in the oil discharge passage exceeds a predetermined level;

a venturi portion formed in said relief passage; and a vacuum passage means providing communication between said venturi portion and said fourth chamber.

9. An EGR control system as claimed in claim 8, in which the vacuum supply means further includes an orifice at said vacuum passage means to provide communication between said fourth chamber and the atmosphere, and a check valve disposed in said vacuum passage means between said orifice and said venturi portion and arranged to open when received a vacuum generated at said venturi portion of the vacuum supply means.

10. An EGR control system as claimed in claim 9, in which said means for decreasing the venturi vacuum effect, further comprises means for decreasing said venturi vacuum applied to said third chamber of said second operating means during the high engine speed operation.

11. An EGR control system as claimed in claim 10, including second passage means providing communication between said venturi and said third chamber, in which the venturi vacuum decreasing means includes a relief valve disposed in said second passage means, said relief valve being arranged to open to induct air into said second passage means during high engine speed and high engine load operations of the engine.

* * * * *